US005158379A

United States Patent [19]

Moriya et al.

[11] Patent Number: 5,158,379

[45] Date of Patent: Oct. 27, 1992

[54] PRINTING STARTING POSITION CONTROLLER FOR SERIAL PRINTER

[75] Inventors: Mikio Moriya, Saitama; Junichi Furukawa, Tokyo, both of Japan

[73] Assignee: Citizen Watch Co., Ltd., Tokyo, Japan

[21] Appl. No.: 557,003

[22] Filed: Jul. 19, 1990

Related U.S. Application Data

[63] Continuation-in-part of Ser. No. 307,285, Feb. 7, 1989, abandoned.

[30] Foreign Application Priority Data

Feb. 9, 1988 [JP] Japan ..... 63-26585

[51] Int. Cl.[5] ..... B41J 21/16

[52] U.S. Cl. ..... 400/279; 400/322

[58] Field of Search ..... 400/279, 320, 322, 323

[56] References Cited

U.S. PATENT DOCUMENTS

| | | | |
|---|---|---|---|
| 4,448,553 | 5/1984 | Yonezawa | 400/322 |
| 4,507,002 | 3/1985 | Matsumoto | 400/322 |
| 4,591,969 | 5/1986 | Bloom | 400/902 |
| 4,628,239 | 12/1986 | Everett | 400/322 |
| 4,701,685 | 10/1987 | Grüner | 400/903 |
| 4,789,874 | 12/1988 | Majette | 400/320 |
| 4,795,285 | 1/1989 | Moriya | 400/320 |
| 4,802,777 | 2/1989 | Yamada | 400/320 |
| 4,806,034 | 2/1989 | Plummer | 400/279 |

FOREIGN PATENT DOCUMENTS

| | | | |
|---|---|---|---|
| 188679 | 11/1983 | Japan | 400/154.4 |
| 146577 | 7/1986 | Japan | 400/903 |

OTHER PUBLICATIONS

Import 5000 Series Theory Manual Feb. 1987 pp. 2-9 to 2-11.

*Primary Examiner*—David A. Wiecking
*Assistant Examiner*—Steven S. Kelley
*Attorney, Agent, or Firm*—Wenderoth, Lind & Ponack

[57] ABSTRACT

A printing controller for a serial printer, wherein a carriage having a printing head is reciprocated by a motor via transmitting a means, includes a carriage position detector for detecting the position of the carriage to produce a position detection signal; a timing signal generator for detecting the rotational position of the motor, thereby producing a timing signal synchronously with the movement of the carriage in a line direction; a synchronizing signal generator for producing a synchronizing signal per each predetermined plurality of timing signal synchronously with the timing signal, and a control circuit for producing a printing initiation signal, on the basis of the position detection signal, the timing signal and the synchronizing signal, in accordance with a first timing signal after the carriage leaves a home position and receives a first synchronizing signal.

2 Claims, 9 Drawing Sheets

PRINTING STARTING POSITION CONTROLLER FOR SERIAL PRINTER

This application is a continuation of now abandoned application, Ser. No. 07/307,285 filed on Feb. 7, 1989.

BACKGROUND OF THE INVENTION

1. Field of the Invention

The present invention relates generally to a serial printer for carrying out uni- or bi-directional printing with a printing head mounted on a carriage and, more particularly, to a printing controller for controlling the initial position of printing.

2. Description of the Prior Art

In serial printers for carrying out printing while reciprocating a carriage by a motor via a transmitting means, the initial printing position has been controlled by using a position signal emitted from a carriage position detector and a timing signal for detecting the rotational position of the motor.

That is, a judgment has been made as to whether or not the carriage is located at a home position (a reference position for the initiation of printing) on the basis of the position detection signal detected by the carriage position detector, and a printing initiation signal has been produced by a timing signal which is first fed to the carriage upon its leaving the home position for the initiation of printing.

However, such conventional serial printers have had the following disadvantage which must be overcome.

That is, there has generally been a need to produce timing signals in at least a half-dot unit, which has further required a high resolving power and, hence, to detect the signals at a high-speed stage of, e.g., a driving shaft of a carriage driving motor. Turning on the other hand to the position detecting signal for detecting the position of the carriage, the movement of said carriage has been detected by using photo-interrupters, lead switches, limit switches and the like. Since the carriage is driven via a transmitting means such as gears and a belt, however, there is a variation in the number of timing signals from the position detection signal for an "on" state to the timing signal for the initiation of printing due to a backlash of a gear train, a flexing of a carriage driving belt and pulley shafts resulting from a fluctuation of the tension of said belt, a dimensional change of components caused by their temperature dependencies, etc. A problem with the prior art has been that such a variation in the number of timing pulses gives rise to a variation in the initial printing position, resulting in irregular printing.

SUMMARY OF THE INVENTION

An object of the present invention is to solve the aforesaid problem by eliminating any positional deviation between the position detecting signal and the timing signal to stabilize the initial printing position.

According to one aspect of the present invention, this object is achieved by the provision of a printing controller for a serial printer wherein a carriage having a printing head is reciprocated by a motor via a transmitting means, which includes: a carriage position detector for detecting the position of said carriage to produce a position detection signal, a timing signal generator for detecting the rotational position of said motor, thereby producing a timing signal synchronously with the movement of said carriage in a line direction, a synchronizing signal generator for producing a synchronizing signal per each predetermined plurality of timing signals synchronously with said timing signal, and a control circuit for producing a printing initiation signal on the basis of said position detection signal and said timing signal and said synchronizing signal, said printing initiation signal being produced by a first timing signal after said carriage leaves a home position and receives a first synchronizing signal.

According to another aspect of the present invention, there is provided a printing controller for a serial printer wherein a carriage having a printing head is reciprocated by a motor via a transmitting means, which includes: a carriage position detector for detecting the position of said carriage to produce a position detection signal, a timing disc fixed to a rotating shaft of said motor and provided with a plurality of marks for timing signals at regular intervals on its circumference and with a mark for a synchronizing signal in between two timing signals disposed each predetermined plurality of timing signals, a timing signal generator for detecting the marks for timing signals from said timing disc, thereby producing a timing signal synchronously with the movement of said carriage in a line direction, a timer for measuring the period of said timing signal, and a control circuit for distinguishing a pulse having a period reduced to a value which is lower than a predetermined value from said timing signal in the form of a synchronizing signal on the basis of said position detection signal and the measurement result of said timer and for producing a printing initiation signal from the next timing signal.

According to the first aspect of the present invention, the position detection signal produced from the carriage position detector and the timing signal from the timing signal generator are fed into the control circuit, which produces a printing initiation signal by a first timing signal after the carriage leaves the home position and receives a first synchronizing signal, as can be seen from the block diagram of FIG. 1. Thus, any deviation in the positional relationship between a position detection signal and a timing signal is so avoidable that printing can always be started from the predetermined position to obtain regular and clean printing.

According to the second aspect as can be seen from the block diagram of FIG. 2, the timer serves to measure the period of pulses of the timing signal generator producing a series of timing signals at regular intervals and one synchronizing signal in between two pulses of said series of timing signals per rotation of the motor and for each predetermined plurality of timing signals. After the carriage leaves the home position, the control circuit serves to distinguish the signal, the period of which is reduced to a value which is lower than the predetermined value, from the timing signal in the form of a synchronizing signal and outputs printing initiation signal by the next timing signal. Therefore, any deviation in the positional relationship between a position detection signal and a timing signal is prevented so as to initiate printing at the regular position.

BRIEF DESCRIPTION OF THE DRAWINGS

Preferred embodiments of the present invention will now be described, by way of example, with reference to the accompanying drawings in which.

DETAILED DESCRIPTION

Figure 1:
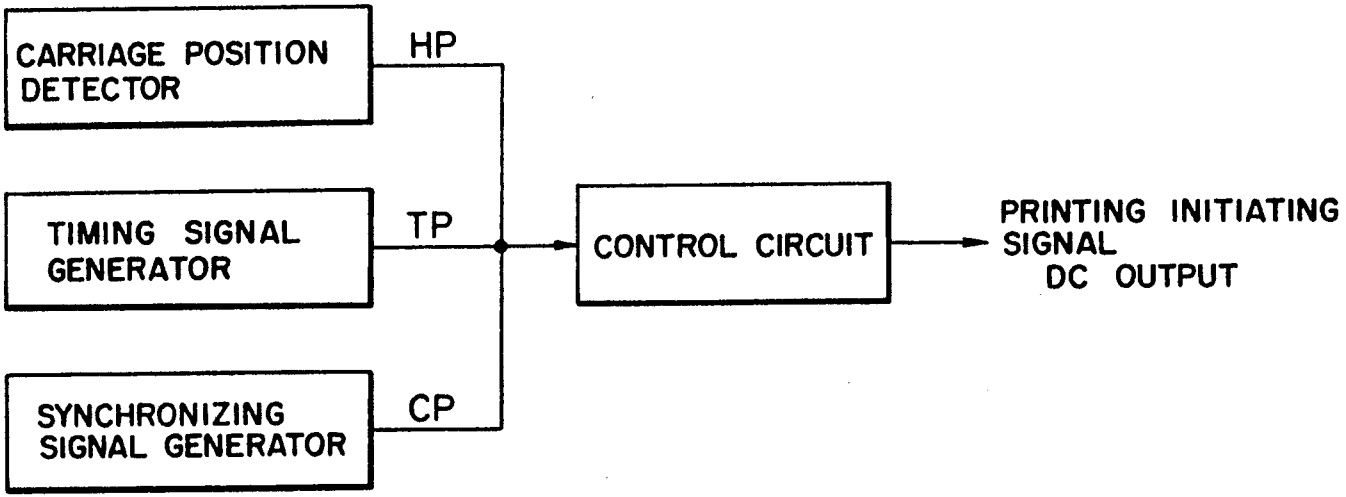
FIG. 1 is a block diagram showing the basic structure of the first aspect of the present invention.
Figure 2:
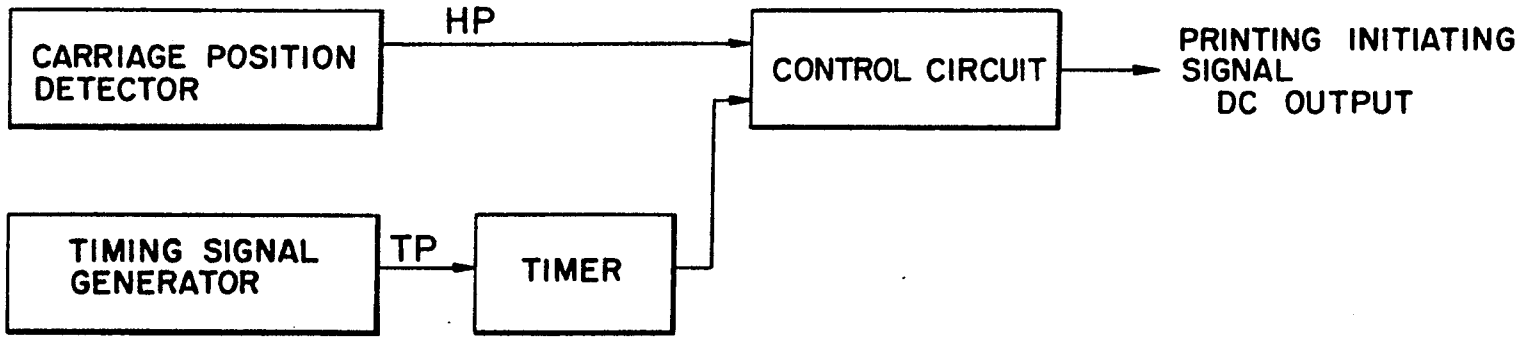
FIG. 2 is a block diagram showing the basic structure of the second aspect of the present invention.
Figure 3:
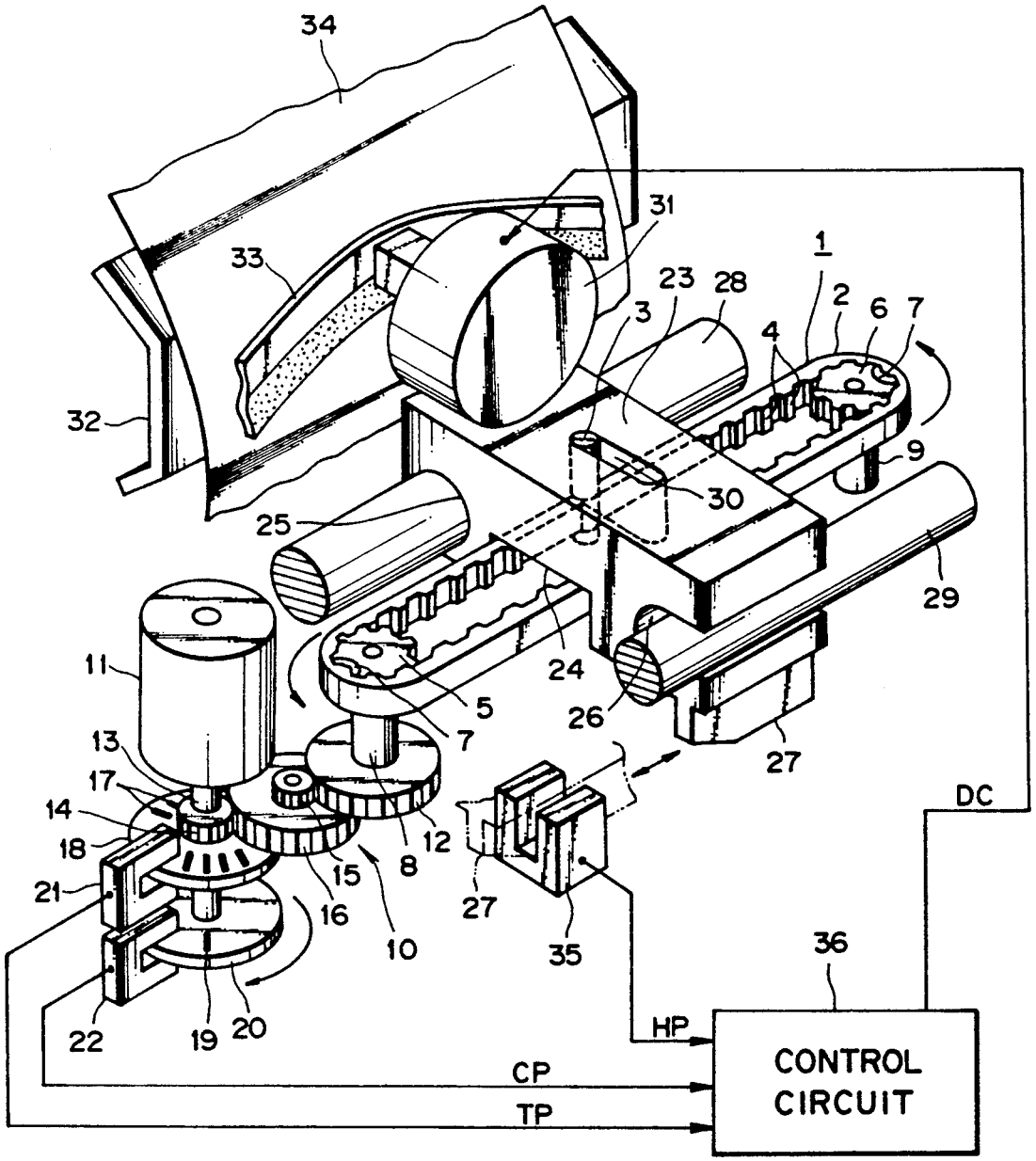
FIG. 3 is a view illustrating one embodiment according to the first aspect of the present invention.

Referring now to FIG. 3, there is given a perspective view of one embodiment of the serial-dot printer to which the invention is applied.

Referring first to the construction of the illustrated printer, an endless belt 1, that is, a transmitting means is constructed of an endlessly continuous belt body 2 and pins 3 provided in the belt body 2 and extending widthwise from its both sides. The belt body 2 is provided with a multiplicity of teeth 4 at regular intervals, each being of a trapezoidal shape in its longitudinal section and the pin 3 is fixedly provided so that it associates with one of the teeth 4.

Said endless belt 1 is located between and around a driving timing pulley 5 and a driven timing pulley 6, both positioned in parallel with each other at a predetermined distance. Each of the timing pulleys 5 and 6 is provided in its outer edge with a pin-receiving groove 7 of a semi-circular shape for allowing it to engage the pin 3, taking its mating timing with the endless belt 1 into account. Such timing pulleys 5 and 6 are rotatably supported on a printer body (not illustrated) by rotating shafts 8 and 9, respectively, with the driving timing pulley 5 being connected to a motor 11 via a reduction gear mechanism 10, that is, a transmitting means so that the driving force of said motor 11 is transmittable to the endless belt 1.

The reduction gear mechanism 10 includes a gear 12 fixed to the rotating shaft 8 of the timing pulley 5 and operatively associated therewith, a gear 14 fixed to a driving shaft 13 of the motor 11 and operatively associated therewith, and two intermediate gears 15 and 15 adapted to mate individually with both gears 12 and 14 and provided as one integral piece. The driving shaft 13 is fixedly provided with a timing disc 18 formed with a plurality of slits 17 at equiangular intervals in its circumferential direction and a synchronizing disc 20 formed with one slit 19 at predetermined intervals in its axial direction.

A photo-interrupter 21 is provided in association with said timing disc 18, and a photo-interrupter 22 in association with said synchronizing disc 20. A timing signal generator outputs a timing signal TP synchronously with the line direction of a carriage 23, and the synchronizing signal generator operates synchronously with said timing signal TP and emits one synchronizing signal CP per each predetermined plurality of timing signals TP.

The carriage 23 is provided in the underside of its longitudinally intermediate portion with a belt groove 24 which is widthwise continuous and downwardly open. Further, the belt groove 24 in the carriage 23 is provided on its both sides with axially extending through-holes 25, support grooves 26 which are open alongside in the longitudinal direction and extend widthwise, and projections 27 which project downwardly and extend widthwise. Through the through-holes 25, there are slidably inserted front guide rails 28 supported at both ends on the printer body, and within the support grooves 26, there are slidably engaged read guide rails 29 again supported at its both ends on the printer body.

The carriage 23 is also provided in its longitudinally intermediate portion with a guide groove 20, which extends in the same direction and passes vertically therethrough and is open at its bottom in the guide groove 30. Within the guide groove 30, there are slidably engaged the pins 3 provided in the endless belt 1 passing in the belt groove 24. The moving forces of the pins 3 cause the carriage 23 to be guided by the two guide rails 28 and 29 for movement in the line direction. Reference numeral 31 represents a printing head mounted on the carriage 23, 32, a platen located in front of the printing head 31, and 33, an ink ribbon interposed between the printing head 31 and the platen 32. Printing then occurs on a sheet 34 fed onto the platen 32 by the printing head 31 via the ink ribbon 33.

A photo-interrupter 35 is provided on an moving locus of the projections 27 of the carriage 23 to detect the position of said carriage 23. A carriage position detector is then defined by the photo-interrupter 35 and the projections 27. When the projections 27 pass by, the carriage position detector converts an "off" signal output to an "on" signal output, and the home position is defined in terms of a time in which the HP position detection signal converts from the "off" to "on" output conversion to the "on" to "off" output conversion. It is to be appreciate that said photo-interrupter 35 may arbitrarily be moved in the moving direction of the carriage, thereby shifting the home position to regulate the printing initiation position.

Figure 4:
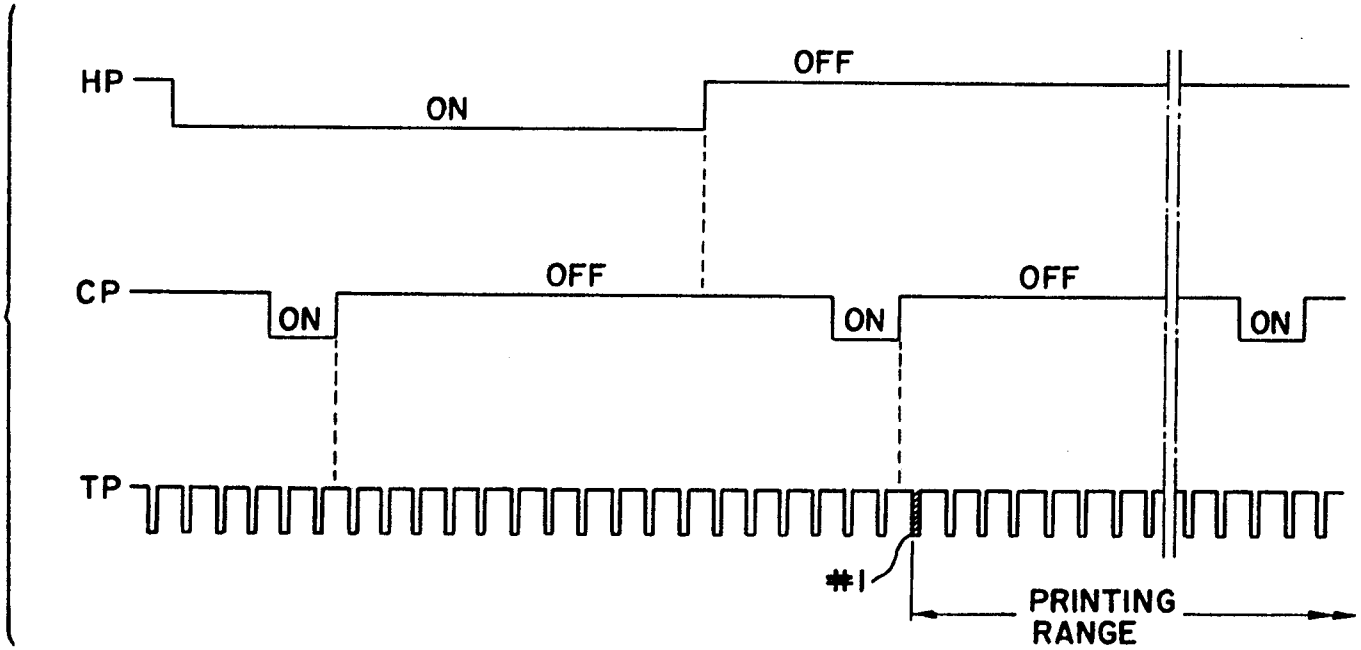
FIG. 4 shows signal waveforms for illustrating the operation of the embodiment of FIG. 3.
Figure 10:
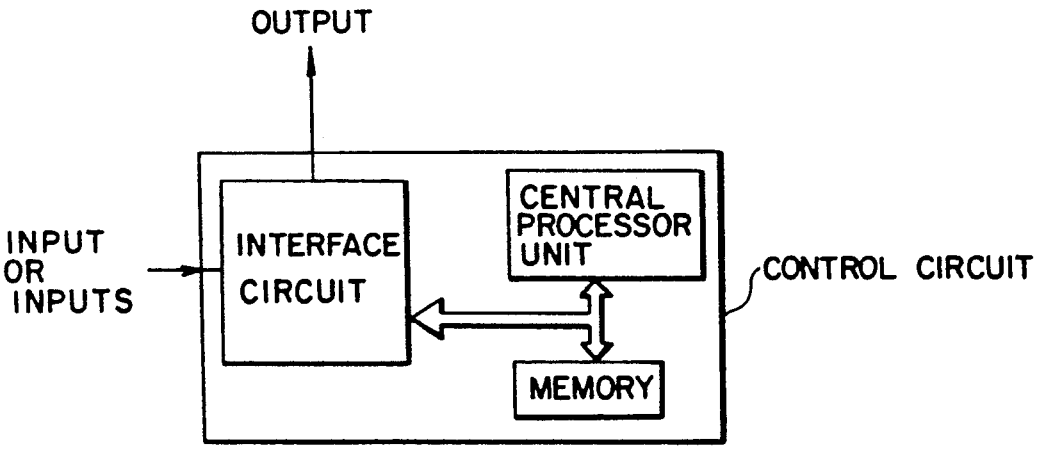
FIG. 10 is a block diagram of a control circuit.

Reference numeral 36 denotes a control circuit to which said position detection, timing and synchronizing signals HP, TP and CP are fed, and which may, for example, be defined by a processor such as a microcomputer. As illustrated in FIG. 10, such a microcomputer includes, e.g., an input/output interface, a central processor unit and a memory. On the basis of said input signals such as those illustrated in FIG. 4 by way of example, operational steps may be executed according to the timer indexing processing program performed every 10 msec., as typically illustrated in FIG. 5.

More specifically, the motor 11 is actuated and a judgment is made as to whether or not the position detection signal HP is in an "off" state at Step 1. When the signal HP is in an "off" state, the carriage 23 is judged to have not yet reached the home position. Then, the processing mode is shifted to Step 2. The processing of Step 2 is repeated until the position detection signal HP is at an "on" state. When the judgmental result of Step 1 shows an "on" state, on the other hand, the carriage 23 is judged to be located in the home position. Then, the processing mode is shifted to Step 3.

At Step 3, a judgment is made as to whether or not the position detection signal HP has been converted to an "off" state. When the judgmental result shows an "on" state, the carriage 23 is judged to be still located in the home position. Then, the same processing is repeated until the position detection signal HP is converted to an "off" state. When the judgmental result shows an "off" state, on the other hand, the carriage 23 is judged to have left the home position. Then, the processing mode is shifted to Step 4.

At Step 4, a judgment is made as to whether or not the synchronizing signal is in an "on" state. When the judgmental result shows an "off" state, the processing of Step 4 is repeated until the synchronizing signal CP is at an "on" state. If the result of judgment shows an "on" state, on the other hand, the processing mode then is shifted to Step 5.

At this Step 5, a judgment is made as to whether or not the synchronizing signal CP has been converted to an "off" state. When the result of judgment shows an "on" state, the carriage 23 is judged to not yet have reached the given position. Then, the processing of Step 5 is repeated until the synchronizing signal CP has been converted to an "off" state. If the result of judgment of Step 5 shows an "off" state, on the other hand, Step 6 is then executed.

At Step 6, a judgement is made as to whether or not an initial timing signal TP #1 is detected after the signal CP is judged to be in an "off" state at Step 5. When the timing signal TP has not yet been detected, the processing of Step 6 is repeated until the signal is detected. If the result of Step 6 indicates that the first timing signal TP #1 is detected, on the other hand, Step 7 is then executed.

At Step 7, the printing head 31 is driven to send out a printing initiation signal DC for the initiation of printing, thereby completing the indexing processing. Then, the operational mode is restored to the main program.

According to this embodiment as described above, the timing and synchronizing signals TP and CP are sent out by the rotation of the driving shaft 13 of the motor 11 for driving the carriage 23. After the position detection signal HP is converted to an "off" state when the carriage 23 leaves the home position, the printing initiation signal DC is emitted by the initial timing signal TP #1 upon receiving the initial synchronizing signal CP. Thus, even when a positional deviation takes place between a position detection signal and a timing signal TP due to, for instance, a backlash of the gear train, a flexing of the carriage-driving belt and pulley shafts because of a fluctuation in the tension of said belt, a dimensional change of the components caused by their temperature dependencies and the like, there is not found any deviation in the AND relationship between both signals, so that irregular printing due to a deviation in the printing initiation position are avoidable.

Figure 6:
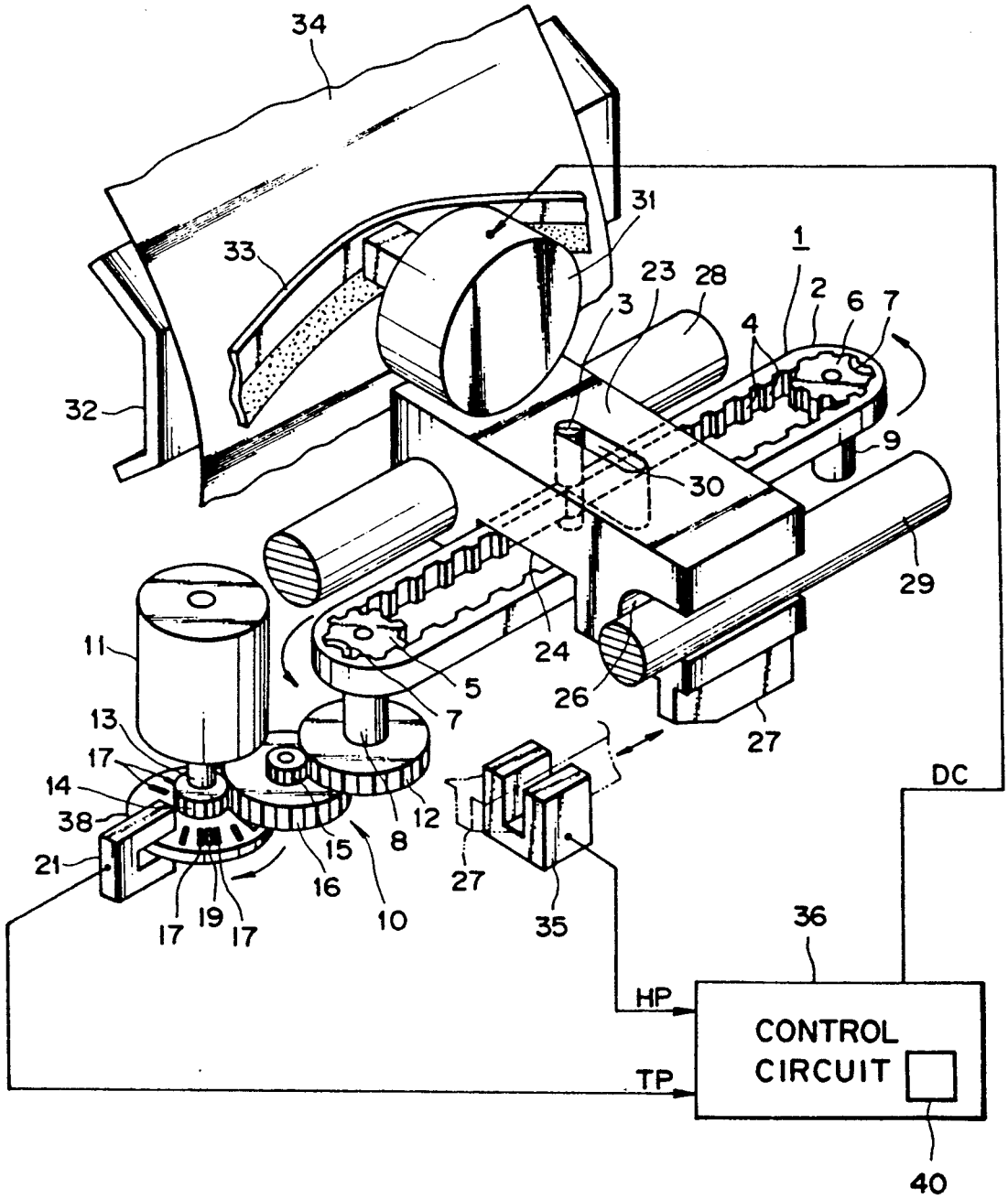
FIG. 6 is a view illustrating one embodiment according to the second aspect of the present invention.

Another embodiment of the present invention will now be described with reference to FIG. 6.

According to this embodiment, a timing disc 38 formed with two types of slits 17 and 19, as referred to in connection with the first embodiment, and a timer 40 for measuring periods between both slits 17 and 19 are provided so as to distinguish a change in such periods, thereby determining the printing initiation position.

Figure 7:
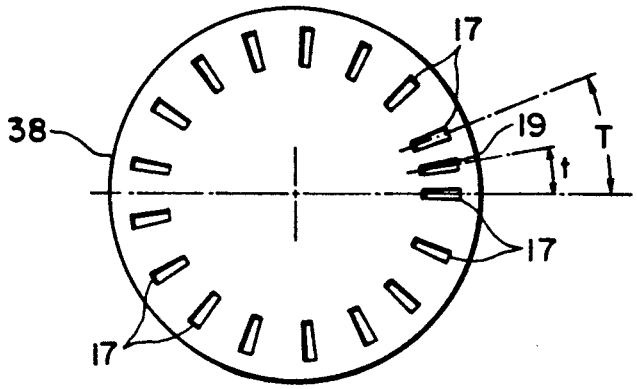
FIG. 7 is a plan view of the timing disc according to the second aspect of the present invention.

As illustrated in FIG. 7, the timing disc 28 includes a plurality of slits (marks for the timing signals) 17 and one slit (a mark for the synchronizing signal) 19 spaced away from one slit 17 at a certain angle t ($T>t$), and is fixed to the driving shaft 13 of the motor 11. Thus, a timing signal generator comprising the timing disc 38 and the photo-interrupter 21 according to this embodiment gives out a pulse signal having a period Tmz corresponding to the predetermined angle T between slits 17 and 17 and pulse signal having a period tmz corresponding to the angle t between slits 17 and 19, as illustrated in FIG. 7. Other structures are similar to those in the first embodiment.

Figure 8:
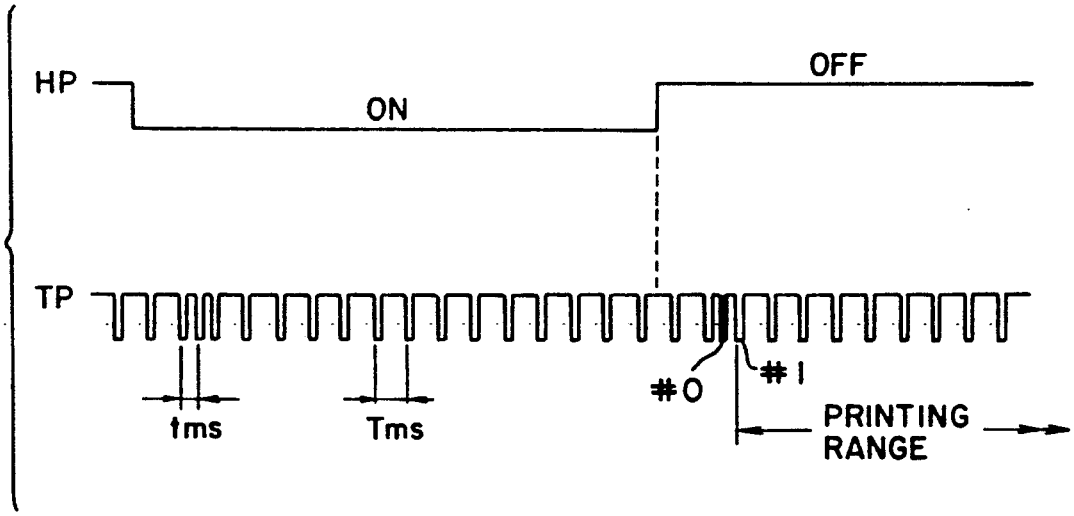
FIG. 8 shows signal wavesforms for illustrating the operation of the embodiment of FIG. 6.
Figure 9:
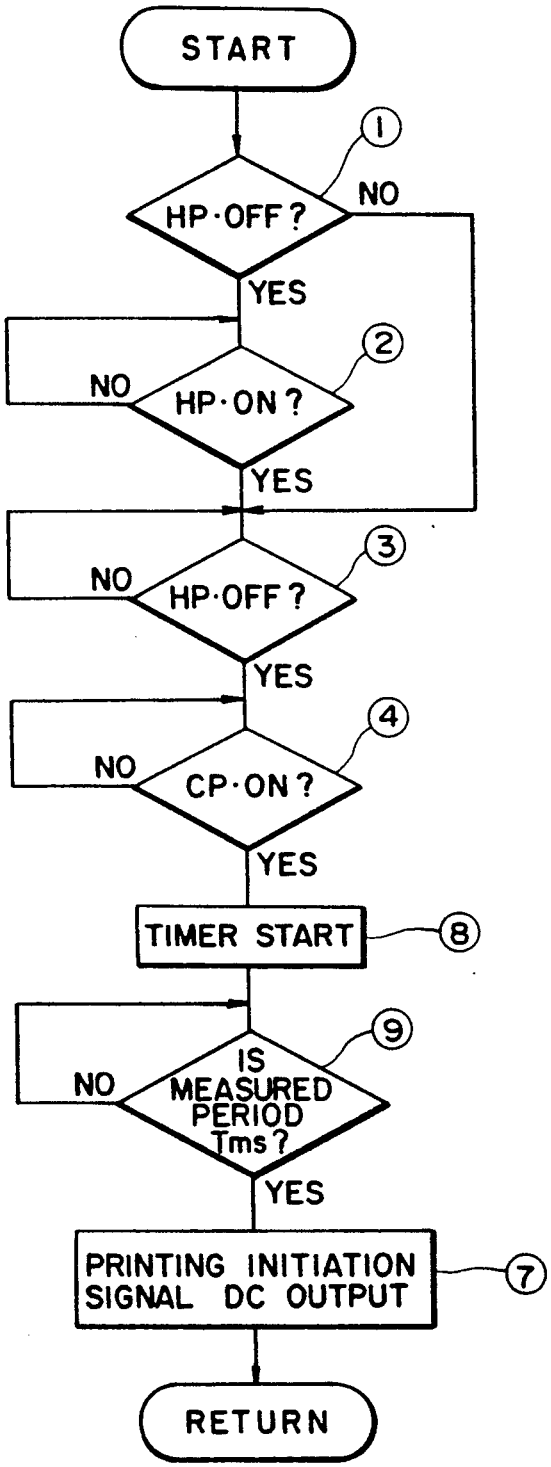
FIG. 9 is a flow chart illustrating the processing steps of the control circuit shown in FIG. 6.

A microcomputer of the control circuit 36 according to this embodiment executes operational processings on the basis of such input signals as illustrated in FIG. 8 by way of example and according to such a timer indexing program as illustrated in the flow chart of FIG. 9 by way of example and executed every 10 msec. by way of example.

Figure 5:
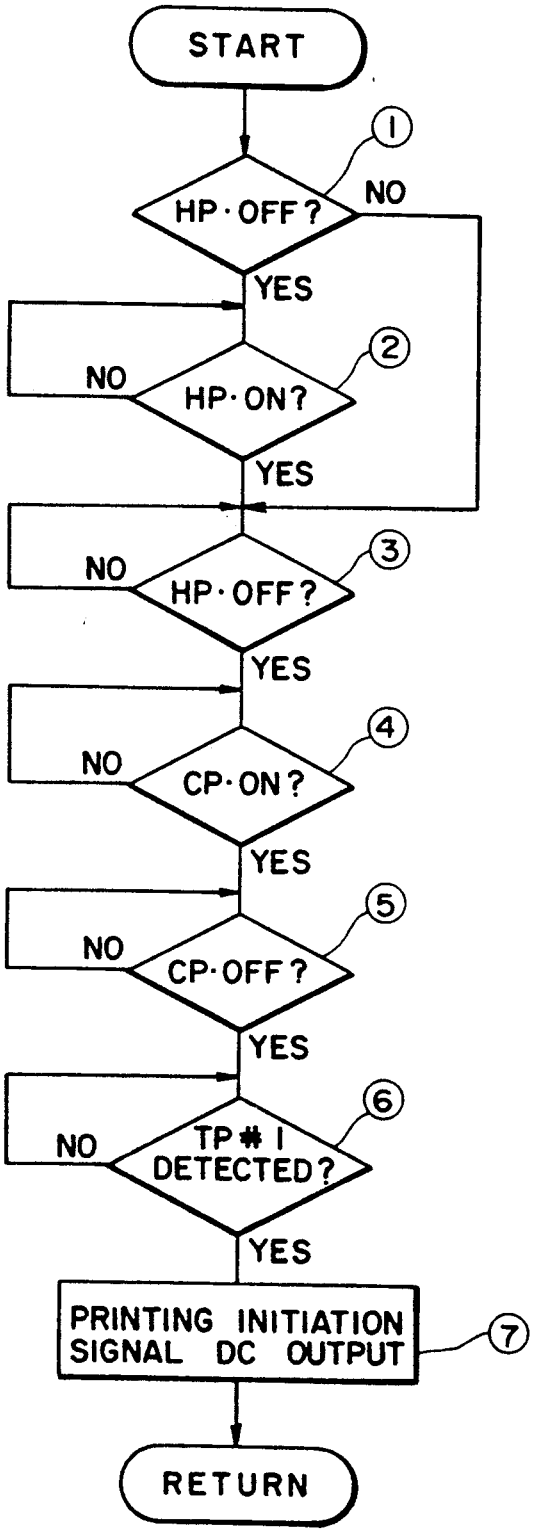
FIG. 5 is a flow chart showing the processing steps of the control circuit illustrated in FIG. 3.

That is, the processing mode is shifted to Step 8 via Steps 1 to 4 of the first embodiment illustrated in FIG. 5 to start the timer 40 so as to successively measure the periods between the respective slits.

Then, the processing mode is shifted to Step 9 at which time a judgment is made as to whether or not the measured period is the predetermined period Tmz. When the result of the judgment indicates that the measured period equals the predetermined period Tmz, the same processing mode is repeated until the timing signal TP having a period tmz which is shorter than said period Tmz is detected. If the judgmental result of Step 9 indicates that the measured period is the period tmz which is shorter than the predetermined period Tmz, on the other hand, the timing signal TP #1 subsequent to the timing signal TP #0, at which the signal is detected, is then judged to be the printing initiation signal TP.

Then, the processing mode is shifted to Step 7 to send out the printing initiation signal DC, thereby completing the indexing proceedings. Afterwards, the operational mode is restored to the main program.

According to this embodiment, two types of timing signals TP having different periods are produced by one timing disc 38, and such periods are measured by the timer 40. After the position detection signal HP is changed to an "off" state when the carriage 23 leaves the home position, the printing initiation signal DC is produced by the timing signal TP #1 subsequent to the timing signal TP #0 reduced to a value lower than the predetermined period Tmz. For the reasons already mentioned, therefore, even when a positional deviation occurs between position detection signal HP and the timing signal TP, there is no deviation in the AND relationship between both signals, thus making it possible to initiate printing at a regular position.

According to the first aspect of the present invention as detailed above, there is provided an arrangement of the carriage position detector, timing and synchronizing signal generators and control circuit wherein, on the basis of the position detection, timing and synchronizing signals, the control circuit produces the printing initiation signal by the first timing signal after the carriage leaves the home position and receives the first synchronizing signal. Thus, even when a positional deviation occurs between a position detection signal and a timing signal due to deviations in the position of transmission of transmitting means, for instance, a backlash of the gear train and a flexing of the carriage driving belt and pulley shafts resulting from a fluctuation in the tension of said belt, there is no deviation in the AND relationship between both signals, so that printing can always be initiated from the predetermined position to prevent irregular printing due to a fluctuation in the printing initiation position.

According to the second aspect of the present invention, timer is provided in place of said synchronizing signal generator to measure the periods of a plurality of slits formed in one timing disc, thereby determining the printing initiation position on the basis of the measurement result and the position detection signal. Thus, any positional deviation between a position detection signal and the timing signal is avoidable, so that printing can always be initiated from the predetermined position to eliminate irregular printing.

It is to be understood that while the present invention has been described, specifically but not exclusively, with reference to the illustrated embodiments, many other modifications and changes may be made within the spirit and scope of the invention as defined in the appended claims.

We claim:

1. A printing controller for a serial printer wherein a carriage having a printing head is reciprocated by a motor via a transmitting means, which includes:

a carriage position detector, including a projection fixed to the carriage and a photo-interrupter provided on a moving locus of said projection at a home position of the carriage, for producing a position detection signal having a first signal level when the carriage is at the home position and a second signal level when the carriage is not at the home position;

a timing signal generator, including a timing disc having plural slits formed at equiangular intervals in its circumferential direction and being fixed to a driving shaft of the motor which rotates in a first direction for moving the carriage in a line direction and a photo-interrupter provided in association with said timing disc, for producing a timing signal containing timing pulses denoting the rotational position of the motor synchronously with the movement of said carriage in the line direction;

a synchronizing signal generator, including a synchronizing disc having one slit and being fixed to the driving shaft of the motor and spaced away from said timing disc in its axial direction and a photo-interrupter provided in association with said synchronizing disc, for producing a synchronizing signal containing one synchronizing pulse per each predetermined plurality of timing pulses synchronously with said timing signal, and a microcomputer control circuit, including an input/output interface and a memory and a central processor unit, for receiving the position detection signal, the timing signal and the synchronization signal, and for executing a timer indexing processing program in which operation steps are performed every preselected time period and in which a printing initiation signal for initiating a printing operation is generated upon receiving in succession a synchronizing pulse and then a timing pulse after the position detection signal has changed from the first level to the second level.

2. A printing controller as recited in claim 1, wherein said timing disc has one of said plural slits formed at every equiangular interval in its circumferential direction.

* * * * *

US005158379B1

REEXAMINATION CERTIFICATE (2813th)

United States Patent [19] [11] B1 5,158,379

Moriya et al. [45] Certificate Issued Mar. 12, 1996

[54] PRINTING STARTING POSITION CONTROLLER FOR SERIAL PRINTER

[75] Inventors: Mikio Moriya, Saitama; Junichi Furukawa, Tokyo, both of Japan

[73] Assignee: Citizen Watch Co., Ltd., Tokyo, Japan

Reexamination Request:
No. 90/003,643, Nov. 25, 1994

Reexamination Certificate for:

| | |
|---|---|
| Patent No.: | **5,158,379** |
| Issued: | **Oct. 27, 1992** |
| Appl. No.: | **557,003** |
| Filed: | **Jul. 19, 1990** |

Related U.S. Application Data

[63] Continuation-in-part of Ser. No. 307,285, Feb. 7, 1989, abandoned.

[30] Foreign Application Priority Data

Feb. 9, 1988 [JP] Japan ..... 63-26585

[51] Int. Cl.[6] ..... B41J 21/16

[52] U.S. Cl. ..... 400/279; 400/322

[58] Field of Search ..... 400/320, 322, 400/328, 279, 162.3, 163, 280; 250/231.13, 231.14, 231.15, 231.17, 231.18

[56] References Cited

U.S. PATENT DOCUMENTS

| | | | |
|---|---|---|---|
| 4,024,941 | 5/1977 | Sekikawa et al. | 400/322 |
| 4,448,553 | 5/1984 | Yonezawa et al. | 400/322 |
| 4,686,510 | 8/1987 | Baker | 250/231.17 |

FOREIGN PATENT DOCUMENTS

| | | |
|---|---|---|
| 58-188679 | 11/1983 | Japan . |
| 58-217382 | 12/1983 | Japan . |

*Primary Examiner*—David A. Wiecking

[57] ABSTRACT

A printing controller for a serial printer, wherein a carriage having a printing head is reciprocated by a motor via transmitting a means, includes a carriage position detector for detecting the position of the carriage to produce a position detection signal; a timing signal generator for detecting the rotational position of the motor, thereby producing a timing signal synchronously with the movement of the carriage in a line direction; a synchronizing signal generator for producing a synchronizing signal per each predetermined plurality of timing signal synchronously with the timing signal, and a control circuit for producing a printing initiation signal, on the basis of the position detection signal, the timing signal and the synchronizing signal, in accordance with a first timing signal after the carriage leaves a home position and receives a first synchronizing signal.

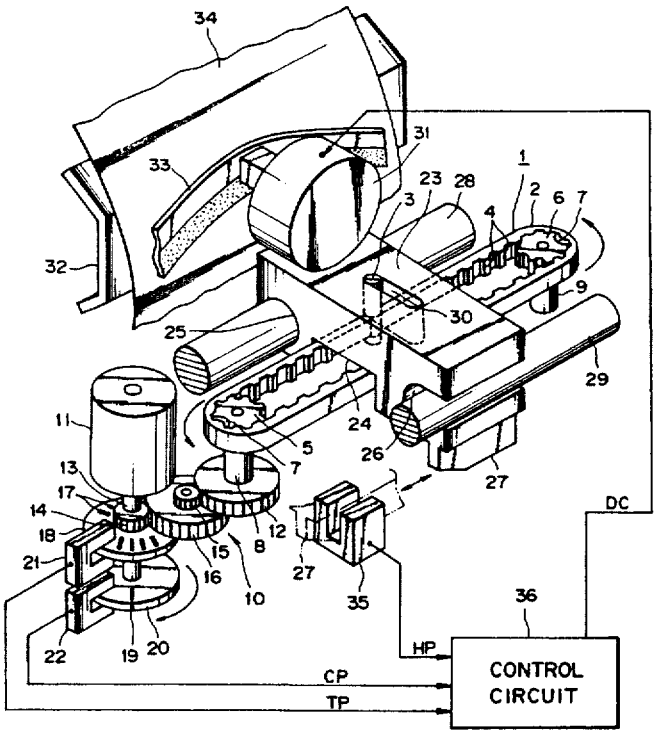

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claim 2, dependent on an amended claim, is determined to be patentable.

1. A printing controller for a serial printer wherein a carriage having a printing head is reciprocated by a motor via a transmitting means, which includes:

a carriage position detector, including a projection fixed to the carriage and a photo-interrupter provided on a moving locus of said projection at a home position of the carriage, for producing a position detection signal having a first signal level when the carriage is at the home position and a second signal level when the carriage is not at the home position;

a timing signal generator, including a timing disc having plural slits formed at equiangular intervals in its circumferential direction and being fixed to a driving shaft of the motor which rotates in a first direction for moving the carriage in a line direction and a photo-interrupter provided in association with said timing disc, for producing a timing signal containing timing pulses denoting the rotational position of the motor synchronously with the movement of said carraige in the line direction;

a synchronizing signal generator, including a synchronizing disc having one slit and being fixed to the driving shaft of the motor and spaced away from said timing disc in its axial direction and a photo-interrupter provided in association with said synchronizing disc, for producing a synchronizing signal containing one synchronizing pulse per each predetermined plurality of timing pulses synchronously with said timing signal, and a microcomputer control circuit, including an input/output interface and a memory and a central processor unit, for receiving the position detection signal, the timing signal and the synchronization signal, and for executing a timer indexing processing program in which operational steps are performed every preselected time period and in which a printing initiation signal for initiating a printing operation is generated upon receiving in succession a *first* synchronizing pulse and then a *next* timing pulse after the position detection signal has changed from the first level to the second level, *wherein the printing initiation signal is generated upon receiving said first synchronizing pulse and said next time pulse regardless of a number of timing pulses generated between a time when the position detection signal has changed from the first level to the second level and a time when the first synchronizing pulse is generated.*

* * * * *